United States Patent [19]

Ueda et al.

[11] 4,231,706

[45] Nov. 4, 1980

[54] IMPELLER OF A CENTRIFUGAL BLOWER

[75] Inventors: Shinjiro Ueda, Kashiwa; Yoshihiro Takada, Ibaraki; Haruo Mishina, Ibaraki; Atsuhiko Kuroda, Ibaraki, all of Japan

[73] Assignee: Hitachi, Ltd., Japan

[21] Appl. No.: 898,995

[22] Filed: Apr. 21, 1978

[30] Foreign Application Priority Data

Apr. 27, 1977 [JP] Japan ..... 52-47918
Apr. 27, 1977 [JP] Japan ..... 52-47919

[51] Int. Cl.[3] ..... F04D 29/30
[52] U.S. Cl. ..... 416/186 R; 415/213 B
[58] Field of Search ..... 416/186, 187; 415/213 B

[56] References Cited

U.S. PATENT DOCUMENTS

| | | | |
|---|---|---|---|
| 1,015,274 | 1/1912 | Keith | 416/186 |
| 1,447,915 | 3/1923 | Watkins | 416/186 |
| 1,781,165 | 11/1930 | Criqui | 416/187 |
| 2,285,266 | 6/1942 | Fullemann | 416/186 |
| 3,221,398 | 12/1965 | Mayne | 416/187 |
| 3,782,851 | 1/1974 | Hackbarth et al. | 416/186 |

FOREIGN PATENT DOCUMENTS

| | | | |
|---|---|---|---|
| 179274 | 12/1953 | Austria | 416/186 |
| 1426866 | 12/1968 | Fed. Rep. of Germany | 416/186 |
| 131051 | 3/1977 | German Democratic Rep. | 416/186 |
| 44-5726 | 3/1969 | Japan | 416/186 |
| 468036 | 4/1975 | U.S.S.R. | 416/186 |

*Primary Examiner*—Everette A. Powell, Jr.
*Assistant Examiner*—A. N. Trausch, III
*Attorney, Agent, or Firm*—Craig and Antonelli

[57] ABSTRACT

In an impeller of a centrifugal blower of the backward type having a relatively large blade inlet width as contrasted with the diameter of the impeller, blades are each shaped, as seen from the axial direction of a rotary shaft, in a concave curve with respect of rotation of the impeller, each of the blades has a larger inlet diameter on the shroud plate side than on the hub plate side, and each of the blades has a leading edge shaped, in a meridional plane, in a smooth convex curve directed radially inwardly of the impeller. By these structural features, it is possible to bring the inlet blade angle into agreement with the inlet relative flow angle at each point of the leading edge of each blade and to reduce the rate of a reduction in the velocity of flow on the shroud plate side. Thus separation of the flow from blade surfaces and production of noise caused thereby can be prevented, and a sufficiently large blade area to achieve high efficiency can be obtained, so that a loss of load on the blade surfaces can be avoided and a higher pressure coefficient than in conventional impellers can be obtained. Each blade can be developed in a plane, and its leading edge can be in the form of a circular arc centered on a side edge of the blade either on the hub plate side or on the shroud plate side. Thus the impeller is hydrodynamically advantageous and easy to fabricate.

3 Claims, 10 Drawing Figures

IMPELLER OF A CENTRIFUGAL BLOWER

LIST OF PRIOR ART REFERENCES (37 CFR 1.56(a))

The following references are cited to show the state of the art:

Bruno Eck, Ventilatoren, Page 432, 1962

Von Heribert Simon, Entwicklung einer Standard-Laufradreihe mit räumlich verwundenen, rückwäwartsgekrümmten Schaufeln für stationäre Radialverdichter, VDI-Z, Pages 121–127, January 1977.

BACKGROUND OF THE INVENTION

This invention relates to impellers of centrifugal blowers, and more particularly to an impeller of a centrifugal blower of the backward type having particular utility in applications for handling various types of gas and capable of achieving a high fluid flow rate, a high pressure coefficient and high efficiency.

In this type of centrifugal blowers, it has hitherto been common practice to use impellers having two dimensional blades of the backward type which have a large blade inlet width and a large blade outlet width. Generally, when attempts are made at increasing the pressure and the fluid flow rate in centrifugal blowers while keeping constant the size and the number of revolutions of the impellers, it is necessary to increase the outlet blade angle, and this results in an increase in the rate of a reduction in the relative velocity of flow in the path of flow within the impeller. More specifically, in conventional impellers, the bend of the flow from a suction port to the leading edge of each blade does not take place smoothly. Particularly, since the flow makes a sharp turn in a short distance on the shroud plate side, there is a high rate of reduction in the flow velocity locally on the shroud plate side and the flow tends to be separated from the surface of each blade. This has given rise to the problems of a reduced performance of the blowers and a production of noise in operation. However, if the distance between the suction port and the leading edge of each blade is increased and the blade inlet diameter is increased to reduce the rate of a reduction in the fluid velocity between the suction port and the blade leading edge, then the length of each blade is reduced and its area becomes small, with the result that a load per unit area of each blade becomes too high. Thus attempts hitherto made at improving the performance of the centrifugal blowers by altering the structural arrangement of the impellers as aforementioned have had the disadvantages of the flow being separated from the blade surfaces and the noise being increased.

SUMMARY OF THE INVENTION

This invention has been developed for the purpose of obviating the aforementioned defects of centrifugal blowers of the prior art. Accordingly an object of the invention is to provide an impeller of a centrifugal blower of the backward type wherein blades are each shaped, in the central line thereof, in a concave curve with respect to the direction of rotation of the impeller, each of the blades has a larger inlet diameter on the shroud plate side than on the hub plate side, and each of the blades has a leading edge shaped, in a meridional plane, in a convex curve directed radially inwardly of the impeller, so that the centrifugal blower can achieve a high fluid flow rate, a high pressure coefficient and high efficiency in spite of its being relatively small in size and easy to fabricate. The term "meridional plane" will refer to an arbitrarily selected plane including the center axis of the rotary shaft.

Another object is to provide an impeller of the type described wherein each of the blade is shaped, when developed in a plane, in such a manner that its leading edge is in the form of an outwardly directed smooth convex curve. By this structural feature, the rate of a reduction in the velocity of flow between a suction port and the leading edge of each blade can be decreased without reducing the area of each blade, and at the same time the flow angle and the blade angle at the leading edge of each blade can be brought into agreement with each other to prevent separation of the flow from the surface of each blade within the impeller. The blower provided with the impeller constructed as aforesaid can achieve improved performance and is free from noise.

DESCRIPTION OF THE PREFERRED EMBODIMENTS

Figure 1:
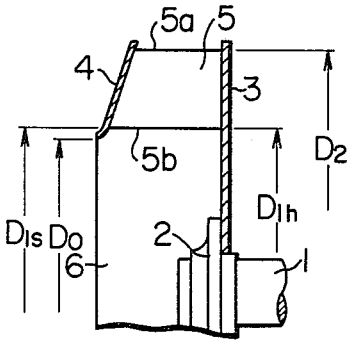
FIG. 1 PRIOR ART
FIG. 1 is a sectional side view of an impeller of a centrifugal blower of the prior art.
Figure 2:
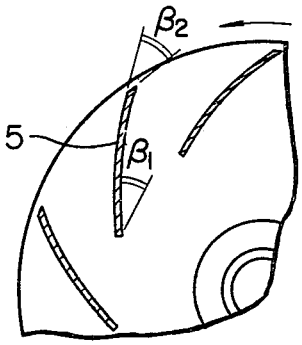
FIG. 2 PRIOR ART
FIG. 2 is a sectional front view of the impeller shown in FIG. 1.

FIGS. 1 and 2 show the construction and shape of an impeller of the prior art. As shown, the impeller includes a rotary shaft 1, a hub 2 attached to the rotary shaft 2, a hub plate 3 of the disk shape attached to the hub 2, a conical shroud plate 4 arranged in spaced juxtaposed relation to the hub plate 3, and a plurality of blades 5 arranged between the hub plate 3 and the shroud plate 4. The numeral 6 designates a suction port. As shown in FIG. 2, each of the blades 5 projected on a plane perpendicular to said rotary shaft is of the two dimensional backward shape and shaped, in its central line, in a convex curve (or in a straight line) with respect to the direction of rotation of the impeller. The words "backward shape" means a blade shape in which the outlet blade angle $\beta_2$ or the angle formed by a blade tangent at the trailing edge of each blade and a circumferential tangent drawn in a direction opposite to the direction of rotation of the impeller is smaller than 90°. As shown in FIG. 1, each of the blades 5 has a trailing edge 5*a* and a leading edge 5*b* which are substantially parallel to the rotary shaft 1.

Figure 3:
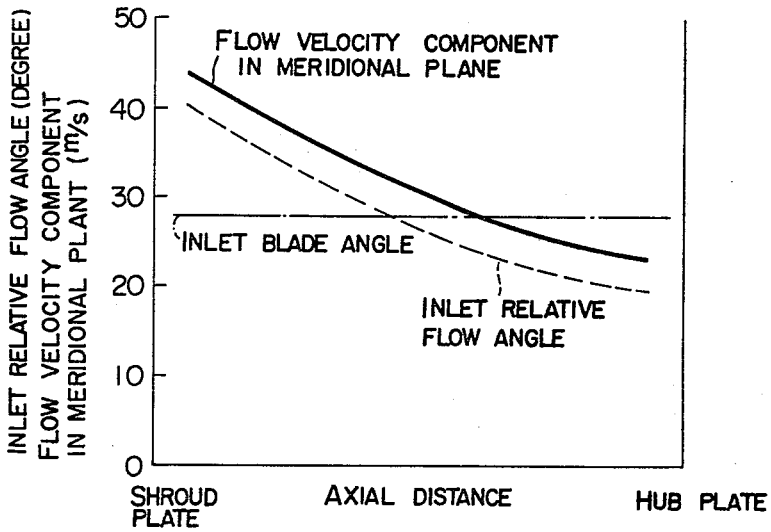
FIG. 3 is a graph showing the distribution of the inlet blade angle and the inlet relative flow angle obtained in the impeller shown in FIGS. 1 and 2.

The impeller has a relatively large blade inlet width as contrasted with the diameter $D_2$ thereof. This causes a considerable difference in the conditions of flow between a portion of the leading edge 5*b* of each blade 5 on the side of the shroud plate 4 and a portion thereof on the side of the hub plate 3. Also, the flow is influenced by the turn it makes from the axial direction to the radial direction, with the result that the flow velocity is lower on the side of the hub plate 3 and higher on the side of the shroud plate 4 as shown in FIG. 3 and consequently the inlet relative flow angle (as measured with respect to a circumferential tangent) is small on the side of the hub plate 3 and large on the side of the shroud plate 4. (The flow velocity component in the meridional plane shown in FIG. 3 is expressed in a value obtained by calculation based on the quasi-three dimensional theory.) Thus, in the impeller of the prior art constructed as shown in FIGS. 1 and 2, the inlet blade angle $\beta_1$ and the inlet relative flow angle are in agreement with each other on an average but they are not in agreement with each other in the majority of the axial range. This gives rise to separation of the fluid from blade surfaces, resulting in reduced performance of the blower.

Figure 4:
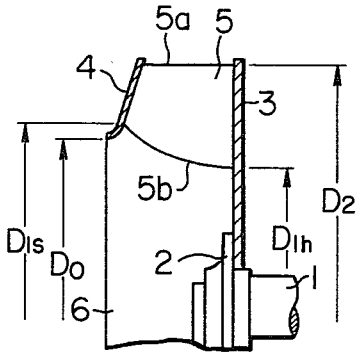
FIG. 4 is a sectional side view of one embodiment of the invention.
Figure 5:
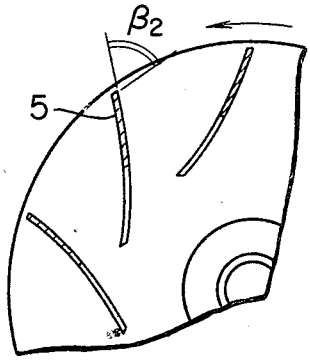
FIG. 5 is a sectional front view of the embodiment shown in FIG. 4.

FIGS. 4 and 5 show an embodiment of the invention. In this embodiment, the shape of the central line of each blade 5 projected on a plane perpendicular to the rotary shaft 1 is such that it is a concave curve with respect to the direction of rotation of the rotary shaft 1. Each blade 5 has an inlet diameter $D_{1s}$ on the side of the shroud plate 4 which is greater than an inlet diameter $D_{1h}$ on the side of the hub plate 3, and the leading edge **5*b* of each blade 5 is shaped, in a meridional plane, in a smooth convex curve directed radially inwardly of the impeller. Since the center line of each blade 5 is concave in shape with respect to the direction of rotation of the rotary shaft 1 in this embodiment, the outlet blade angle $\beta_2$ of the impeller of the embodiment is larger than that of the impeller of the prior art shown in FIGS. 1 and 2. Although the impeller of the embodiment has a larger inlet diameter $D_{1s}$ on the side of the shroud plate 4 than the impeller of the prior art, the inlet diameter $D_{1h}$ on the side of the hub plate 3 is smaller in the former than in the latter, and the leading edge 5*b*** of each blade of the former is in the form of a convex curve directed radially inwardly of the impeller in the former, so that the former is substantially equal to the latter in the total blade area.

Figure 6:
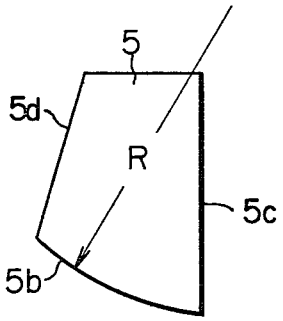
FIGS. 6 to 8 are developed views of various embodiments of the blade in conformity with the invention.
Figure 7:
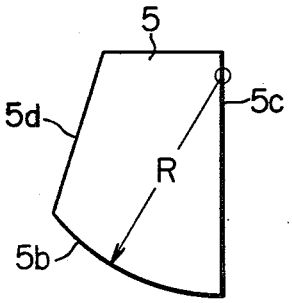
Figure 8:
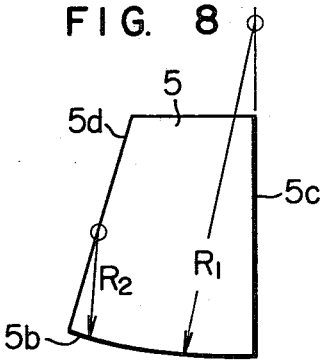

FIGS. 6 and 8 show various embodiments of the invention having different shapes when developed in a plane, particularly in explanation of methods for forming the leading edge **5*b* of each blade 5. In each of the embodiments shown, the leading edge 5*b* passes predetermined positions on side edges of the blade 5 on the side of the hub plate 3 and on the side of the shroud plate 4, and is in the form of an outwardly directed smooth convex curve. In the embodiment shown in FIG. 6, the leading edge 5*b* consists of a single circular arc, and this embodiment has the advantages of being simple in drawing and fabricating blades. The leading edge 5*b* of the blade 5 shown in FIG. 7 consists of a single circular arc centered on a side edge 5*c* on the side of the hub plate 3. In this embodiment, the leading edge 5*b* is at right angles to the side edge 5*c* on the side of the hub plate 3, so that the embodiment offers an advantage in that, when fluid is admitted, the flow near the hub plate 3 is in a good balance or equilibrium of pressure in a direction perpendicular to the hub plate 3. Conversely, the circular arc constituting the leading edge 5*b* may be centered on a side edge 5*d* of the blade 5 on the side to the shroud plate 4. This embodiment offers an advantage similar to the embodiment shown in FIG. 7 with respect to the fluid flow near the shroud plate 4 in the vicinity of the inlet of the blade 5. It should be noted, however, that in general the embodiment shown in FIG. 7 often provides a more suitable shape of the blade 5**.

The leading edge **5*b* of the blade 5 shown in FIG. 8 consists of two circular arcs contiguous with each other, and either one or both of the centers of imaginary circules of which the two arcs form a part respectively are located on the side edge 5*c* on the side of the hub plate 3 or on the side edge 5*d* on the side of the shroud plate 4. This embodiment offers, in addition to an advantage similar to the advantage offered by the embodiment shown in FIG. 7, an advantage in that the agreement between the flow angle and the blade angle can be made more complete. FIG. 8 shows the embodiment in which the centers of the two circular arcs are located on the side edges 5*c*, 5*d* respectively, but one of the arcs may be centered out of the side edges. This can be determined depending on the view point of which should be laid stress on between the overall agreement between the flow angle and the blade angle along the leading edge 5*b* of the blade 5 and the local inflow condition of fluid in the vicinity of the hub plate 3 or shroud plate 4**.

The invention offers advantages which are summarized hereinafter.

(1) An increase in the outlet blade angle $\beta_2$ improves the pressure coefficient or increases the pressure per unit diameter and number of revolutions, thereby improving the effective output power of the blower.

(2) The distance between the suction port and the leading edge of each blade is considerably large and the radius of curvature at the inlet of the shroud plate is increased, so that the rate of a reduction in flow velocity in this section can be decreased and a loss which would otherwise be caused by separation of the flow from blade surfaces, etc. can be minimized. Also, an increase in the diameter $D_0$ of the suction port enables a suction fluid flow rate to be increased.

(3) Blades have a total blade area which is substantially the same as the total blade area in conventional impellers, so that there is no great difference in the loss of load of each blade per unit area between impellers of the invention and the prior art and a loss within the impeller of the invention is not increased in spite of the increase in pressure. The flow path within the impeller is improved as a whole, thereby contributing to an increase in the efficiency of the blower.

Figure 9:
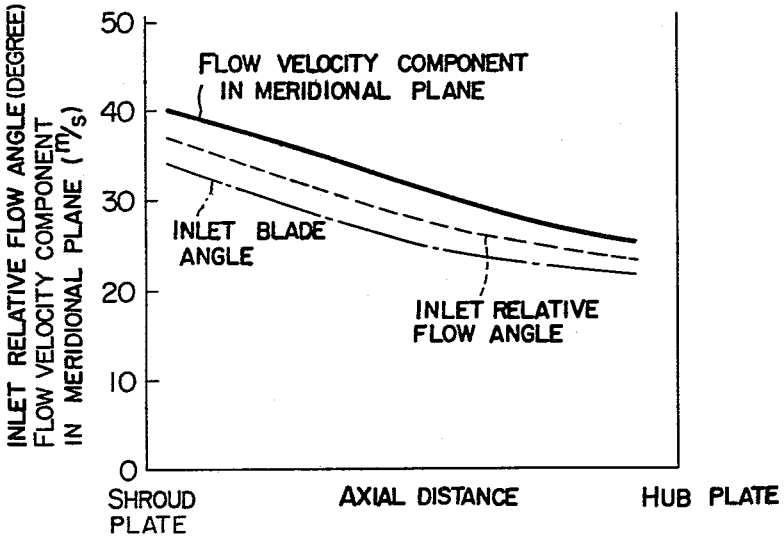
FIG. 9 is a graph showing the distribution of the inlet blade angle and the inlet relative flow angle obtained in the embodiment shown in FIGS. 4 and 5.

(4) By virtue of the structural arrangements that the inlet diameter on the side of the shroud plate is made greater than the inlet diameter on the side of the hub plate and the leading edge of each blade is shaped in a smooth convex curve directed radially inwardly of the impeller, the blade angle and the flow angle at the leading edge of each blade can be brought into agreement with each other. This characteristic is shown in FIG. 9. In the figure, it will be seen that, in the impeller according to the invention, the inlet flow angle on the side of the shroud plate is smaller than the corresponding angle obtained in the conventional impeller and approaches a uniform distribution, and that at the same time the axial distribution of the inlet blade angle is substantially similar to the distribution of the flow angle, showing that the inlet blade angle is in agreement with the flow angle. These features make it possible to minimize, if not eliminate, a loss which would otherwise be caused to the impeller at the blade inlet by the separation of the fluid flow from blade surfaces.

Figure 10:
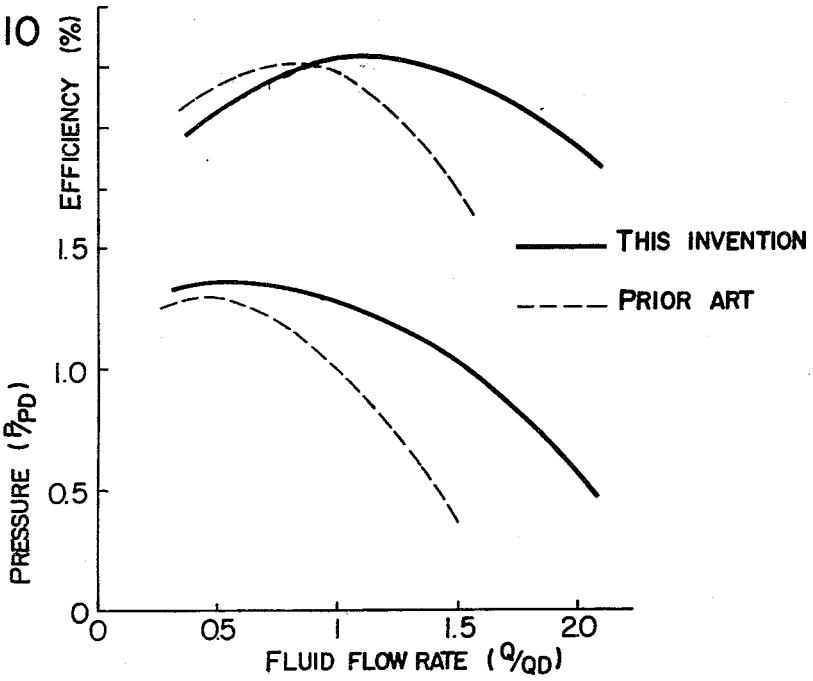
FIG. 10 is a graph showing the performance characteristics of a blower having the impeller according to the invention as compared with those of a blower of the prior art.

FIG. 10 shows a comparison in performance of a blower having the impeller according to the invention with a blower of the prior art having the same diameter $D_2$ and the same number of revolutions. In the figure, solid line curves indicate the performance of the blower according to the invention and broken line curves indicate that of the blower of the prior art. (The fluid flow rate and pressure characteristics are represented as the ratios of the fluid flow rate Q and the pressure P to the design fluid flow rate $Q_D$ and the design pressure $P_D$ of the blower of the prior art.) It will be seen that the blower according to the invention shows a marked increase in the fluid flow rate and pressure and an improvement in efficiency as well.

In the embodiments shown and described hereinabove, reference has been made to the blades in plate form. It is to be understood, however, that the invention is not limited to this form of blades and that similar results can be achieved when applied to blades having crosssectional shapes of airfoils.

From the foregoing description, it will be appreciated that the present invention makes it possible to minimize a loss which would otherwise occur due to a reduction in fluid velocity in the suction port of an impeller, to allot an optimum value to a load applied to the blades, and to improve the outputs (the fluid flow rate and pressure) of an impeller. Thus it is possible to obtain an overall compact size and a light weight in a blower for the required fluid flow rate and pressure. It is also possible to bring the blade angle and the flow angle into agreement with each other at the leading edge of each blade and to thereby reduce the chances of fluid flow being separated from blade surfaces. Accordingly, the invention enables the performance of a centrifugal blower to be improved and permits noise to be reduced, if not eliminated.

What we claim is:

1. An impeller of a centrifugal blower comprising:

a hub plate in the form of a disk;

a cone-shaped shroud plate;

a rotary shaft supporting said hub plate; and a plurality of two dimensional backward shaped blades made of sheet material and arranged between said hub plate and said shroud plate, each of said blades having relatively large blade inlet and outlet widths and a given blade area;

wherein the improvement comprises arrangements whereby the center line of each of said blades projected on a plane perpendicular to said rotary shaft is shaped in a concave curve with respect to the direction of rotation of said rotary shaft so as to provide an increased outlet blade angle, and the inlet diameter of each of said blades on the side of said shroud plate is greater than the inlet diameter thereof on the side of said hub plate, and the leading edge of each of said blades is shaped, in a meridional plane, in a convex smooth curve directed radially inwardly of the impeller whereby said blade area is not substantially reduced regardless of said increased outlet blade angle.

2. An impeller of a centrifugal blower as claimed in claim 1, wherein, when each of said blades is developed in one plane, the leading edge thereof consists of a single circular arc or a smooth curve including a circular arc, said circular arc being centered on the side edge of the blade or an extension thereof adjacent to said shroud plate or said hub plate.

3. An impeller of a centrifugal blower as claimed in claim 1, wherein, when each of said blades is developed in one plane, the leading edge thereof consists of two circular arcs contiguous with each other or a smooth curve including two circular arcs, at least one of said two circular arcs being centered on the side edge of the blade or an extension thereof adjacent to said shroud plate or said hub plate.

* * * * *